United States Patent [19]

Sturdy

[11] Patent Number: 4,727,837

[45] Date of Patent: Mar. 1, 1988

[54] ENGINE GOVERNOR WITH EMERGENCY THROTTLE LIMITER

[75] Inventor: Harry D. Sturdy, Wilmington, N.C.

[73] Assignee: Sturdy Corporation, Wilmington, N.C.

[21] Appl. No.: 44,225

[22] Filed: Apr. 30, 1987

[51] Int. Cl.[4] ..... F02D 31/00

[52] U.S. Cl. ..... 123/361; 123/396; 123/399

[58] Field of Search ..... 123/350, 352, 361, 396, 123/398, 399; 180/178

[56] References Cited

U.S. PATENT DOCUMENTS

| | | | |
|---|---|---|---|
| 2,174,062 | 9/1939 | Raesler | 123/350 |
| 3,547,216 | 12/1970 | Marie | 180/107 |
| 4,368,704 | 1/1983 | Masaki | 123/339 |
| 4,523,564 | 6/1985 | Sturdy | 123/361 |

*Primary Examiner*—Andrew M. Dolinar

*Attorney, Agent, or Firm*—Reising, Ethington, Barnard, Perry & Milton

[57] ABSTRACT

An emergency throttle limiter is disclosed for a top speed limiting governor of a vehicle. The governor is of the type which comprises an overriding throttle closing device for moving the throttle to a position for limiting the engine speed to a governed value. A brake is provided for arresting the throttle closing device against movement in the open throttle direction and an electromagnet maintains the brake in a released condition as long as electrical power is supplied to the governor. When the power supply is interrupted, the electromagnet is deenergized and allows the brake to be engaged to arrest the overriding throttle control device against movement in the open throttle direction.

4 Claims, 5 Drawing Figures

ENGINE GOVERNOR WITH EMERGENCY THROTTLE LIMITER

FIELD OF THE INVENTION

This invention relates to engine governors. More particularly, it relates to an improved arrangement for allowing reduced operating speed in the event that the governor is disabled or malfunctions.

BACKGROUND OF THE INVENTION

Engine governors are well known which are adapted to limit the engine speed to a preset top speed with only brief excursions above the top speed. Such governors typically operate to regulate the flow of fuel to the engine and are of the type which comprise a throttle closing means which overrides the manually actuable throttle. A governor of this type is disclosed in my U.S. Pat. No. 4,523,564 granted June 18, 1985. The governor of this patent is especially adapted for use in automotive vehicles with either spark ignited engines or diesel engines.

In the use of such vehicle engine governors, it is not uncommon for the vehicle driver to attempt to disable the governor so that the vehicle can be operated at speeds above the top speed set by the governor. One way to disable the governor is to cut the supply voltage line to the governor. Aside from driver tampering, it is possible that the voltage supply to the governor would be cut off by reason of a malfunction. In the prior art, it is known to discourage drivers from tampering with the governor by causing the engine to shut down if the voltage supply to the governor is interrupted. It is known, for spark ignited engines, to connect the ignition coil in series through the battery supply line for the governor so that if the supply line is cut, the ignition voltage is interrupted and the vehicle cannot be driven. It is also known for diesel engine governors to use a shut-down solenoid connected to the battery voltage through the governor supply line so that if the supply line is cut the solenoid drops out and shuts off the fuel. In the Marie U.S. Pat. No. 3,547,216 granted Dec. 15, 1970, a system is disclosed with an ignition resistance wire inside the governor housing to prevent burn out of the ignition primary coil. If the driver attempts to use a jumper wire from the battery to the ignition coil after cutting the voltage supply line to the governor, the bypassing of the resistance wire will cause the coil to burn out.

In a fast idle device for engine warm up operation, as distinguished from top speed limiting governors, it is known to use a ratchet mechanism for holding the throttle at a fast idle position until certain engine conditions obtain and then releasing it to a slower idle position. Such an arrangement is disclosed in Masaki U.S. Pat. No. 4,368,704 granted Jan. 18, 1983.

Shutting down the engine in response to the loss of governor supply voltage or other malfunction is undesirable in that it leaves the vehicle inoperative and stranded. It is desirable to provide a governor with the capability of allowing operation of the engine at a reduced limiting speed even though the governor becomes inoperative.

A general object of this invention is to provide an improved top speed limiting governor which overcomes certain disadvantages of the prior art.

SUMMARY OF THE INVENTION

In accordance with this invention, an engine governor is provided with means for permitting operation of the engine at a reduced limiting speed even though the governor is disabled.

Further, in accordance with this invention, holding means are provided for arresting the overriding throttle closing means against movement in the open throttle direction. Control means are provided for operating the holding means in response to a disablement of the governor, such as interruption of the supply voltage. This prevents movement of the throttle in the open throttle direction by the accelerator pedal when no electrical power is supplied to the governor.

A more complete understanding of this invention may be obtained from the detailed description that follows taken with the accompanying drawings.

BEST MODE FOR CARRYING OUT THE INVENTION

Figures 1, 2:
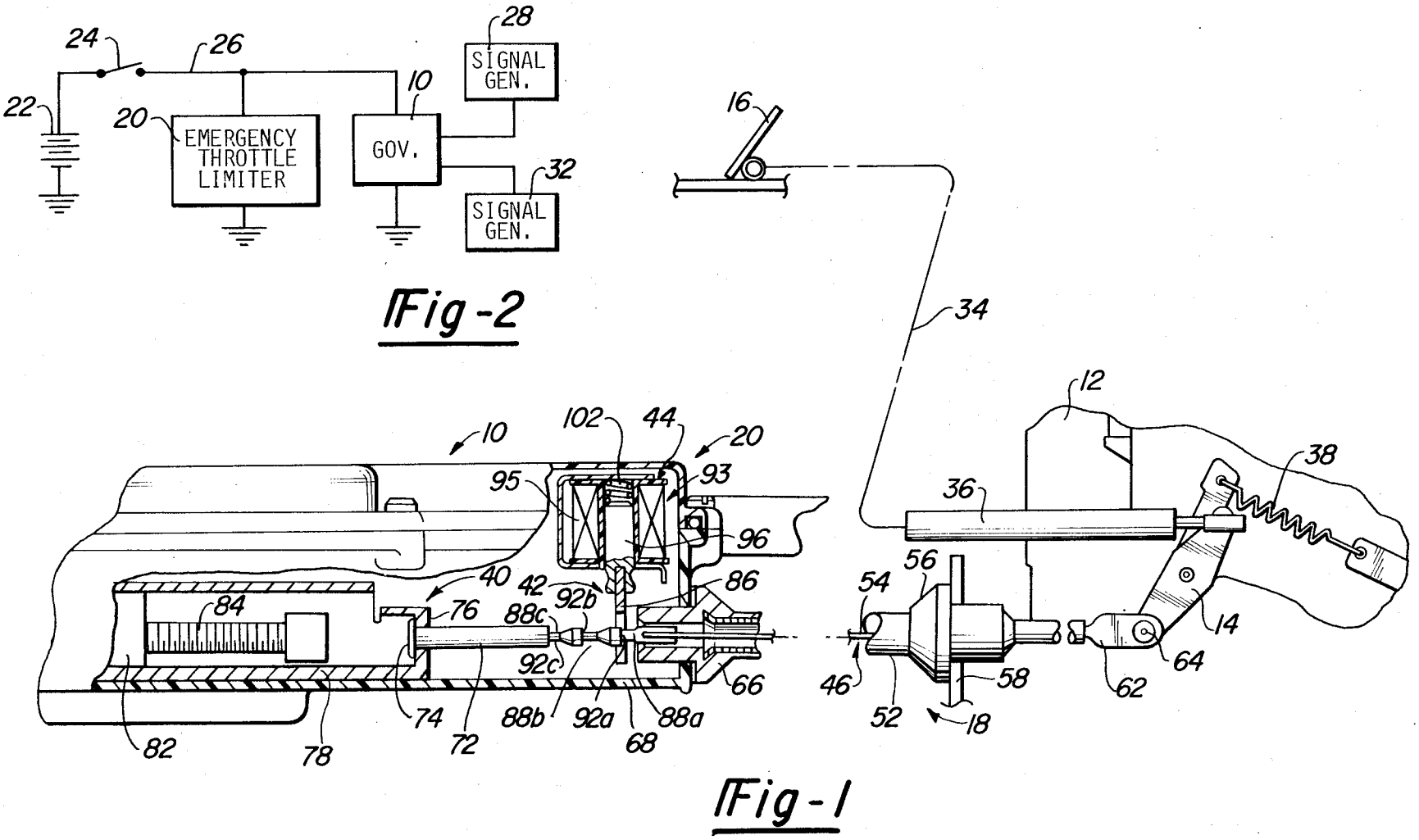
FIG. 1 shows a governor incorporating the subject invention in one operating condition.
FIG. 2 is a schematic of the electrical connections to the governor.

Referring now to the drawings, there is shown as illustrative embodiment of the invention in an emergency throttle limiter for an engine governor. This embodiment is especially adapted to arrest the control cable of the overriding throttle limiting means of the governor installed in an automotive vehicle having a carburetor. It will be appreciated as the description proceeds that the invention may be embodied in different forms and is adapted for many different applications.

FIG. 1 represents an automotive vehicle governor system incorporating the emergency throttle limiter of this invention. The governor system comprises, in general, a governor 10 for the vehicle engine 12 (shown fragmentarily) which is provided with a throttle lever 14 of a conventional carburetor. An accelerator pedal 16 is coupled with the throttle lever 14 for control of the carburetor by the driver. The governor 10 is coupled with the throttle lever 14 through a governor linkage 18. An emergency throttle limiter 20, in accordance with this invention, is installed in the governor 10. The system will be described in greater detail below.

Before describing the inventive emergency throttle limiter 20, it will be helpful to consider the operation of the governor system. The governor 10 is suitably of the type described in the above-mentioned Sturdy Pat. No. 4, 523,564. The governor 10, in a typically installation, is adapted to limit the road speed to a prescribed upper or top speed limit, such as 55 MPH. The governor is also adapted to limit the engine speed so that it does not exceed a maximum safe speed, such as 4300 RPM, except for brief excursions. For this purpose, the governor 10 receives engine speed and road speed information and imposes a limit on the throttle opening of the engine. As depicted schematically in FIG. 2, the governor 10 is supplied with electrical power from the vehicle battery 22 through an ignition switch 24 and through a supply conductor 26. The governor also receives an engine speed signal from a signal generator 28 and a road speed signal from a signal generator 32. The governor is mechanically connected by the linkage 18 with the throttle lever 14 of the engine carburetor to limit the opening of the throttle. Referring again to FIG. 1, the primary control of the throttle movement remains under the control of the driver by the accelerator pedal 16. The accelerator pedal 16 is connected with the throttle arm 14 through a flexible cable 34 and a spring loaded lost motion device 36. The device 36 comprises an elongated tube containing a compressable spring through which the force on the cable 34 is transmitted to the throttle arm 14. A throttle return spring 38 acts through an intermediate lever on the throttle plate of the carburetor and biases it toward the idle position.

The governor 10, as described in the above-mentioned U.S. Pat. No. 4,523,564, comprises a reversible electrical servo motor which is drivingly connected through a linear actuator 40 with the governor linkage 18. When the engine and road speeds are below the governed speeds, the linkage 18 is in an extended or open throttle position and the position of the throttle lever 14 is controlled by the accelerator pedal 16. In this condition, the movement of the accelerator pedal is transmitted through the cable 34 and the lost motion device 36 to the throttle lever 14 until the movement of the throttle lever is restrained by the linkage 18. When this occurs, further movement of the accelerator pedal toward the wide open throttle position will merely compress the spring in the device 36. When the governor linkage 18 is in a retracted or close throttle position, the normal throttle control by the accelerator pedal 16 will be overriden and the movement of the throttle lever 14 will be limited according to the position of the governor linkage 18.

If the electrical power supply to the governor 10 is interrupted for some reason, the governor becomes inoperative. Drivers have been known to purposely cut the power supply line to a governor for the purpose of disabling it with the expectation that the vehicle can be driven at speeds greater than the governed speed. Unless special provisions are made, the vehicle may be driven without the overriding control of the governor when the power supply is interrupted. The emergency throttle limiter 20 of this invention, is provided to restrict the vehicle speed to a reduced limiting value in the absence of governor control. The emergency throttle limiter 20 will be described presently.

The emergency throttle limiter 20 comprises, in general, a holding means 42 and a control means 44. The holding means 42 is interposed in the governor linkage 18 between the linear actuator 40 and the throttle lever 14. Before describing the details of the holding means 42 and control means 44, it will be helpful to consider the structure and operation of the governor 10.

The governor linkage 18 comprises a flexible cable 46 having a cable sheath 52 and a push/pull wire or cable core 54. The sheath 52 terminates at one end in the grommet or retainer 56 which is mounted on a bracket 58 at the engine near the carburetor. The cable core 54 extends through the retainer 56 nd terminates in an end fitting 62 which is connected with a pivot pin 64 on the end of the throttle arm 14. At the other end, the cable sheath 52 terminates in a retainer 66 which is mounted on the end of the governor housing 68. The end of the core 54 is connected with a cable end rod 72 which carried an annular flange or washer 74 at its outer end. The cable end rod 72 extends through a slot in the end wall 76 of a tension tube 78 which forms the movable part of the linear actuator 40. The tension tube 78 is mounted on and carried by a travelling nut 82 which is reciprocably driven by a lead screw 84 which is stationary with respect to the governor housing 68 and rotatably driven through a gear train by the servo motor of the governor. When the tension tube 78 is in its fully retracted or close throttle position, as shown in FIG. 1, the movement of the cable core 54 is restricted thereby so that the throttle lever 14 is held in the close throttle position even though the accelerator pedal is depressed to the wide open throttle position. When the tension tube 78 is in its fully extended or wide open position, i.e. the position shown in FIG. 3, the cable end washer 74 is disposed closely adjacent the end wall 76. It is spaced from the fixed end of the lead screw 84 by a sufficient travel distance to allow free movement of the cable core 54 when the accelerator pedal is moved throughout the full range between closed throttle and wide open throttle. When the tension tube 78 is in an intermediate position, the cable core 54 and the throttle lever 14 are allowed free movement in the open throttle direction until the washer 74 engages the end wall 76 of the tension tube and the throttle is limited to this position even though the accelerator pedal is fully depressed. The structure and operation of the governor as just described, except for the emergency throttle limiter 20, are already known as disclosed in my U.S. Pat. No. 4,523,564 cited above.

As mentioned above, the emergency throttle limiter 20 comprises, in general, a holding means 42 and a control means 44. The holding means takes the form of a brake in which the cable end rod 72 forms the movable brake element and a reciprocable fork 86 constitutes the fixed brake element. For this purpose, the rod 72 is provided with three end-to-end sections 88*a*, 88*b* and 88*c* with reduced diameter which form stop shoulders 92*a*, 92*b* and 92*c* at the ends thereof. The fork 86 is provided with a bifurcated end having spaced tines 94*a* and 94*b* which are adapted to straddle the sections of the rod 72 and engage the stop shoulders 92*a*, 92*b* or 92*c* depending upon the position of the rod. The fork 86 operates in the manner of a guillotine and when it is extended into engagement with the rod 72 the cable core 54 is arrested against movement in the open throttle position by the nearest stop shoulder 92*a*, 92*b* or 92*c*.

The control means 44 comprises a solenoid or electromagnet 93 mounted on the housing 68 of the governor 10. The electromagnet includes a movable plunger 96 which extends through an opening in the housing and is connected with the fork 86. The electromagnet 93 has a coil winding 95 which is connected between the power supply conductor 26 and ground as shown in FIG. 2. The plunger 96 is biased toward the extended position by a coil spring 98 and is held in its retracted position when the coil is energized. The electromagnet 93 is energized and the plunger 96 is retracted as long as it receives power through the power supply conductor 26. Whenever that power supply is interrupted, as by severance of the conductor 26, the governor 10 is disabled and the electromagnet 93 is deenergized.

The operation of the emergency throttle limiter 20 is as follows. When the vehicle is operated, the governor 10 will move the tension tube 78 to various positions depending upon the operating conditions. For example, when the engine ignition switch is turned on, the governor 10 is energized through the conductor 26 and the governor causes the tension tube 78 to move to the wide open throttle position. This allows the driver complete control of the throttle by means of the accelerator pedal. When the engine is started and is running at idle speed with the transmission in neutral, the governor moves the tension tube 78 to an intermediate throttle position. When the vehicle is moving, say at 8 MPH, the governor will move the tension tube back to the wide open throttle position and it will stay in that position until the governed speed is reached and then modulating action takes place. Other movements and positions of the tension tube 78 will be provided by the governor depending upon operating conditions.

Figure 3:
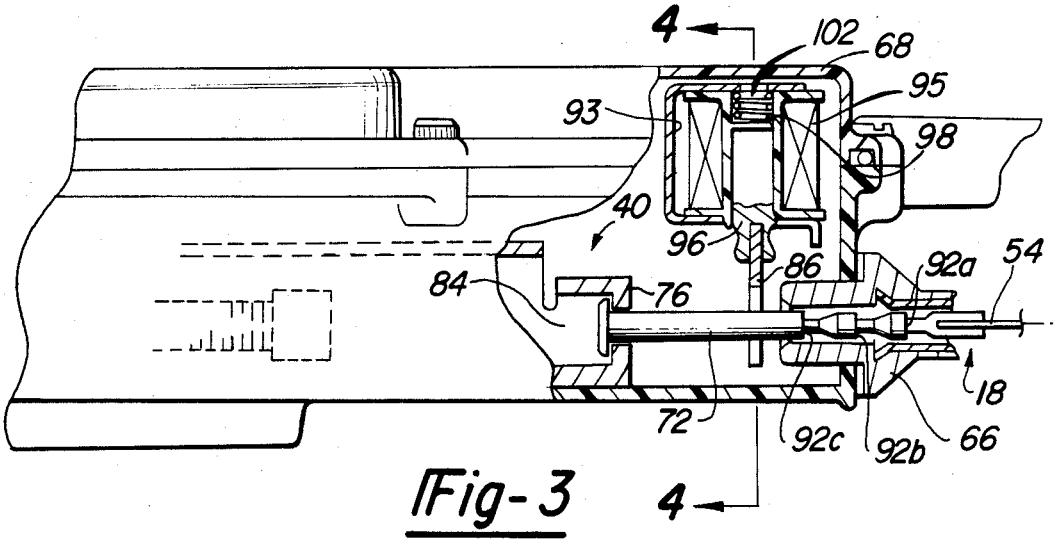
FIG. 3 shows the governor in a different operating condition.
Figure 5:
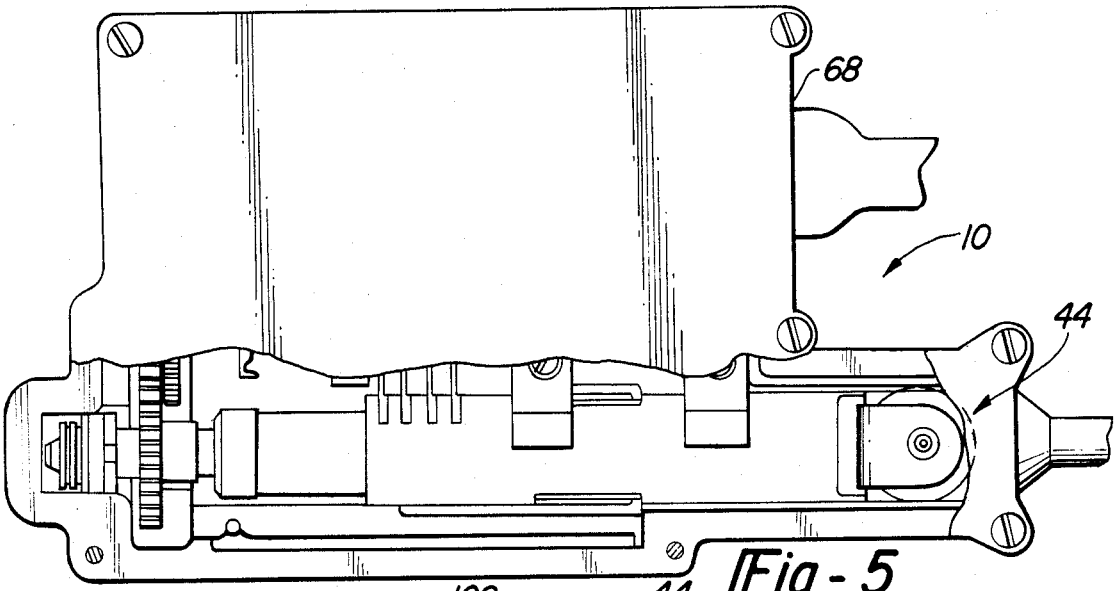
FIG. 5 is a top view of the governor with a part of the cover broken away.
Figure 4:
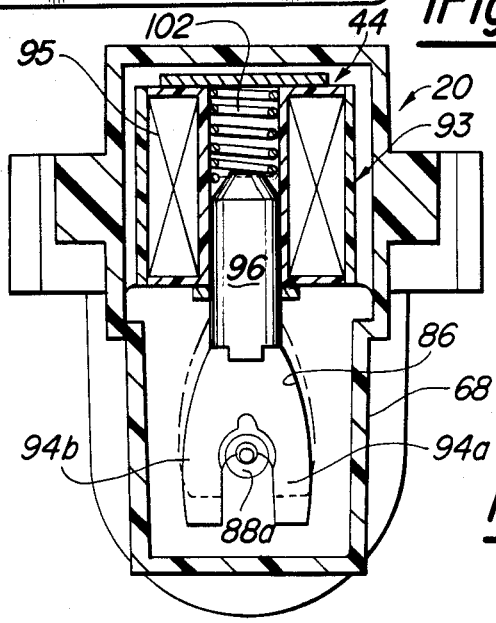
FIG. 4 is a view taken on lines 4—4 of FIG. 3.

When the power supply to the governor 10 through the conductor 26 is interrupted, due to a malfunction or deliberate cutting of the wire of the conductor 26, the governor is disabled and the electromagnet 93 is deenergized. thus, the plunger 96 drops due to gravity if is mounted in a vertical position or due to the bias spring 98 if not. This causes the fork 86 to engage the rod 72 at a location depending upon the position of the cable core 54. If the governor linkage 18 and hence, the rod 72 are held in the closed throttle position, as shown in FIG. 1, the tines of the fork 86 will engage the stop shoulder 92*a*. Thus, the throttle lever 14 will be held in the closed throttle position by the governor linkage 18 and any effort by the driver to open throttle by the accelerator pedal 16 will cause the spring in the lost motion device 36 to be compressed. If the power supply to the governor is interrupted with the tension tube 78 in the wide open throttle position, as shown in FIG. 3, the fork 86 will straddle the rod 72 at a location depending upon the position of. the throttle lever 14. If the driver is holding the accelerator pedal 16 for wide open throttle, the rod 72 will be pulled by the cable core 54 so that the shoulders 92*a*, 92*b* and 92*c* are all inside the retainer 66 and the fork 86 will engage the cylindrical portion of the rod 72. As long as the driver maintains the throttle lever 14 in the wide open throttle position, the operation at high speed can be maintained. However, if the accelerator pedal is released to some extent, the throttle return spring 38 on the throttle lever 14 will be effective to rotate the lever so that the governor linkage 18 pushes the rod 72 into the clearance space in the tension tube 78. When this motion takes place, the shoulder 92*c* on the rod 72 will move past the fork 86 and the fork will engage the smaller diameter section 88*c* of the rod 72 and arrest the governor linkage 18 against movement in the open throttle direction by engagement of the tines of fork 86 with the shoulder 92*c*. If the driver should further release the accelerator pedal, the rod 72 would move further in the close throttle direction and the fork 86 would be cammed in its retracting direction by the ramp surface on the rod section 88*c* and the stop shoulder 92*b* would be engaged by the tines of the fork 86. If the driver should release the accelerator pedal further toward the idle position, the governor linkage 18 will be moved further in the close throttle direction by the throttle return spring 38. It will then be held by the stop shoulder 92*a* against movement in the open throttle direction and will thus be held at a position preselected for reduced driving speed, below the governed speed, for emergency purposes. When the power supply to the governor 10 is restored, the plunger 96 is retracted and the emergency throttle limiter 20 is reset for another operating cycle.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In a governor for an engine having a throttle movable between an open throttle position and a close throttle position for regulating the flow of fuel to the engine, said governor being of the type comprising an overriding throttle closing means, a control means including engine speed sensing means, and actuating means for moving said throttle closing means to a position for limiting the engine speed to a predetermined governed value, said governor being of the type which requires electrical power supply for operation and including an electrical conductor for supplying electrical power to the governor from a power source, the improvement comprising:

holding means for arresting said overriding throttle closing means against movement in the open throttle direction, and control means for operating said holding means to arrest said overriding throttle control means in response to interruption of the supply voltage to said governor, whereby movement of the throttle in the open throttle direction is prevented.

2. The invention as defined in claim 1 wherein:

said holding means allows movement of said overriding throttle control means in the close throttle direction when said holding means is operated to arrest said overriding throttle closing means.

3. The invention as defined in claim 1 wherein:

said holding means comprises a one-way brake having a first braking member on said overriding throttle control means and a second braking member movable by said control means for engagement and disengagement of said braking members whereby said overriding throttle control means is held by said brake against movement in the open throttle direction and is allowed movement by said brake in the close throttle direction.

4. The invention as defined in claim 1 wherein:

said holding means includes a holding member movable between a holding position and a release position, and said control means comprises an electromagnet for retaining said holding member in said release position, said electromagnet being energized through said conductor whereby said holding member moves to said holding position when the electrical continuity of said conductor is interrupted.

* * * * *